US010012227B2

(12) United States Patent
Yoshitani et al.

(10) Patent No.: US 10,012,227 B2
(45) Date of Patent: Jul. 3, 2018

(54) FLUID SUPPLY DEVICE

(71) Applicant: TBK CO., LTD., Machida-shi Tokyo (JP)

(72) Inventors: Hirotada Yoshitani, Yamato (JP); Takeshi Hoji, Sagamihara (JP)

(73) Assignee: TBK CO., LTD., Tokyo (JP)

( * ) Notice: Subject to any disclaimer, the term of this patent is extended or adjusted under 35 U.S.C. 154(b) by 252 days.

(21) Appl. No.: 14/784,696

(22) PCT Filed: Apr. 23, 2013

(86) PCT No.: PCT/JP2013/002721
§ 371 (c)(1),
(2) Date: Oct. 15, 2015

(87) PCT Pub. No.: WO2014/174549
PCT Pub. Date: Oct. 30, 2014

(65) Prior Publication Data
US 2016/0076531 A1 Mar. 17, 2016

(51) Int. Cl.
*F04B 49/06* (2006.01)
*F04B 17/05* (2006.01)
*F04B 53/08* (2006.01)
*F01P 7/16* (2006.01)
(Continued)

(52) U.S. Cl.
CPC ..... *F04B 49/06* (2013.01); *F01P 5/10* (2013.01); *F01P 7/162* (2013.01); *F04B 17/05* (2013.01);
(Continued)

(58) Field of Classification Search
CPC ..... F01P 7/16; F01P 7/165; F01P 2060/04; F01P 2037/02
See application file for complete search history.

(56) References Cited

U.S. PATENT DOCUMENTS 7,267,084 B2 * 9/2007 Lutze ..... F01P 3/20 123/41.02
8,430,071 B2 * 4/2013 Carlson ..... F01P 5/12 123/41.1
(Continued)

FOREIGN PATENT DOCUMENTS

CN 101949322 A 1/2011
DE 10332949 A1 2/2005
(Continued)

OTHER PUBLICATIONS

Office Action dated Jul. 19, 2016, issued in counterpart Chinese Patent Application No. 201380075961.2, with English translation. (17 pages).
(Continued)

*Primary Examiner* — Patrick Hamo
(74) *Attorney, Agent, or Firm* — Westerman, Hattori, Daniels & Adrian, LLP

(57) ABSTRACT

An engine cooling device includes a first supply pump driven by an engine, a second supply pump driven by an electric motor, a first fluid path switching valve, a temperature detector, a revolution speed detector that detects the revolution speed of the engine, and a controller that controls the actuation of the electric motor and the fluid path switching valve. When the temperature of the engine detected by the temperature detector (engine cooling water temperature) is less than a first predetermined temperature, the controller performs control to restrict the supply of the cooling fluid from the first supply pump to the engine by switching the fluid path switching valve to a restricted state, and to supply the cooling fluid from the second supply pump to the engine by performing control to drive the electric motor.

14 Claims, 6 Drawing Sheets

(51) Int. Cl.
*F01P 5/10* (2006.01)
*F01P 5/12* (2006.01)
*F01P 7/14* (2006.01)

(52) U.S. Cl.
CPC ..... *F04B 53/08* (2013.01); *F01P 2005/105* (2013.01); *F01P 2005/125* (2013.01); *F01P 2007/146* (2013.01); *F01P 2037/02* (2013.01)

(56) References Cited

U.S. PATENT DOCUMENTS

| | | | | |
|---|---|---|---|---|
| 8,631,772 | B2 * | 1/2014 | Gooden | B60K 11/06 123/196 AB |
| 9,212,600 | B2 * | 12/2015 | Sasaki | F01P 7/16 |
| 2006/0157000 | A1 * | 7/2006 | Lutze | F01P 3/20 123/41.02 |
| 2008/0317595 | A1 | 12/2008 | Hoji | |
| 2011/0005474 | A1 * | 1/2011 | Carlson | F01P 5/12 123/41.1 |

FOREIGN PATENT DOCUMENTS

| | | | |
|---|---|---|---|
| FR | 2519694 | A1 | 7/1983 |
| JP | 2008-290636 | A | 12/2008 |
| JP | 2012-177308 | A | 9/2012 |
| JP | 2012-215079 | A | 11/2012 |
| JP | 2013-57290 | A | 3/2013 |
| WO | 2006/035552 | A1 | 4/2006 |
| WO | 2013/047148 | A1 | 4/2013 |

OTHER PUBLICATIONS

International Search Report dated Jul. 16, 2013, issued in counterpart International Application No. PCT/JP2013/002721 (2 pages).
Extended (Supplementary) European Search Report dated Dec. 1, 2016, issued in counterpart European Patent pplication No. 13883181.3. (6 pages).

* cited by examiner

FLUID SUPPLY DEVICE

TECHNICAL FIELD

The present invention relates to a fluid supply device that supplies a cooling fluid to a driving source to cool the driving source.

TECHNICAL BACKGROUND

An engine cooling device provided at an automotive engine or the like is an example of such a fluid cooling device. In a water-cooled engine, such as an automotive engine, water (cooling water) has been used as a medium (coolant) for cooling a cylinder or cylinder head. An engine cooling device is configured such that the cooling water is supplied into a water jacket, which is formed inside the cylinder block of the engine, and forcibly circulated to cool the engine. The supply of the cooling water is performed by a cooling water supply pump driven by the engine, and the engine is cooled by the cooling water which is supplied into the water jacket in an amount corresponding to the revolution speed of the engine (see, for example, Patent Document 1). The cooling water supply pump is required to have a capacity (pump capacity) to supply cooling water such as to prevent the engine from overheating even under severe operation conditions under which the engine load is large. Thus, the cooling water supply pump is required to have a large pump capacity that makes it possible to prevent the engine from overheating when used in combination with a radiator even under assumed severe operation conditions, rather than the capacity required under normal operation conditions.

PRIOR ARTS LIST

Patent Document

Patent Document 1: International Patent Publication No. WO 2006/035552A1

SUMMARY OF THE INVENTION

Problems to be Solved by the Invention

However, in the automotive engines, it is necessary to supply the cooling water in an amount corresponding to the engine temperature to the water jacket and perform efficient cooling while suppressing wasteful energy consumption for driving the cooling water supply pump. In particular, during a warm-up operation in which the engine temperature is raised to a temperature range suitable for driving (the lowest temperature in this temperature range is called "warm-up completion temperature"), it is necessary to restrict the amount of cooling water supplied to the water jacket of the engine and minimize the time required for the warm-up operation while suppressing wasteful energy consumption. However, as mentioned hereinabove, the capacity of the cooling water supply pump is set to a level adaptable to severe operation conditions, such high-capacity cooling water supply pump is driven by the engine at all times, and the cooling water is supplied at all times to the water jacket in an amount corresponding to the engine revolution speed. The resultant problem is that the cooling water amount is difficult to control correspondingly to the engine temperature; in particular, since the cooling water corresponding to the engine revolution is also supplied during the warm-up operation, the warm-up operation takes time, and energy is wasted on driving the cooling water supply pump.

Where a configuration is used in which an electric motor is separately provided and the cooling water supply pump is driven by the electric motor rather than by the engine, control to, for example, suppress the amount of cooling water supplied during the warm-up operation becomes possible, the effective warm-up operation is enabled, and wasteful energy consumption is suppressed. However, with such a configuration, a large electric motor capable of driving a cooling water supply pump of a large capacity which has been set in the above-described manner, or a battery of a large electric capacity suitable for such driving is required. The resultant problem is that the electric motor and battery are increased in size and the installation space is increased.

The present invention has been created to solve the above-described problems, and it is an objective of the present invention to provide a fluid supply device configured to be capable of controlling adequately the amount of supplied cooling fluid, while avoiding the increase in the device size, and cooling a driving source efficiently.

Means to Solve the Problems

The fluid supply device in accordance with the present invention supplies a cooling fluid to a rotational driving source and cools the driving source, the fluid supply device including: a first supply pump that is driven by the driving source and supplies the cooling fluid to the driving source; a second supply pump that is driven by an electric motor and supplies the cooling fluid to the driving source; supply switching means for switching between a supply state in which the cooling fluid is supplied by the first supply pump to the driving source and a restricted state in which the supply of the cooling fluid by the first supply pump to the driving source is restricted; temperature detection means for detecting a temperature of the driving source; revolution speed detection means for detecting a revolution speed of the driving source; and actuation control means for controlling actuation of the electric motor and the supply switching means on the basis of detection results from the temperature detection means and the revolution speed detection means. When the temperature of the driving source detected by the temperature detection means is less than a first predetermined temperature, the actuation control means performs control to restrict the supply of the cooling fluid from the first supply pump to the driving source by switching the supply switching means to the restricted state, and to supply the cooling fluid from the second supply pump to the driving source by performing control to drive the electric motor.

In the fluid supply device, it is preferred that the actuation control means be configured such that, when the temperature of the driving source detected by the temperature detection means is equal to or higher than the first predetermined temperature, the actuation control means: restricts the supply of the cooling fluid from the first supply pump to the driving source by switching the supply switching means to the restricted state, and causes the cooling fluid to be supplied from the second supply pump to the driving source by performing control to drive the electric motor, when the revolution speed of the driving source detected by the revolution speed detection means is less than a first predetermined revolution speed; performs control to increase slowly the supply of the cooling fluid from the first supply pump to the driving source by performing control to switch the supply switching means slowly from the restricted state to the supply state as the revolution speed of the driving source increases from the first predetermined revolution speed to a second predetermined revolution speed, when the revolution speed of the driving source detected by the revolution speed detection means is equal to or greater than the first predetermined revolution speed and less than the second predetermined revolution speed; and causes the cooling fluid to be supplied from the first supply pump to the driving source by switching the supply switching means to the supply state, when the revolution speed of the driving source detected by the revolution speed detection means is equal to or greater than the second predetermined revolution speed.

In the fluid supply device, it is preferred that when the revolution speed of the driving source detected by the revolution speed detection means is equal to or greater than the first predetermined revolution speed and less than the second predetermined revolution speed and when the revolution speed of the driving source is equal to or greater than the second predetermined revolution speed, control to drive the electric motor be also performed to cause the cooling fluid to be supplied also from the second supply pump to the driving source.

In the fluid supply device, it is preferred that the actuation control means control a revolution speed of the electric motor according to at least either one of the revolution speed detected by the revolution speed detection means and the temperature detected by the temperature detection means, when the electric motor is driven.

In the fluid supply device, it is preferred that the supply switching means be configured from a switching valve provided in a flow path through which the cooling fluid discharged from the first supply pump is supplied to the driving source, and switching between the supply state in which the cooling fluid is supplied from the first supply pump to the driving source and the restricted state in which the supply of the cooling fluid from the first supply pump to the driving source is restricted be performed by switching actuation of the switching valve.

In the fluid supply device, it is preferred that the supply switching means be configured from a power transmission control device provided in a power transmission system which transmits rotational driving power from the driving source to the first supply pump, and switching between the supply state in which the first supply pump is driven by the driving source to supply the cooling fluid from the first supply pump to the driving source and the restricted state in which the drive of the first supply pump by the driving source is cut off to restrict the supply of the cooling fluid from the first supply pump to the driving source be performed by actuation control of the power transmission control device.

Advantageous Effects of the Invention

In accordance with the present invention, control is performed to supply the cooling fluid from the second supply pump to the driving source by performing control to restrict the supply of the cooling fluid from the first supply pump to the driving source and drive the electric motor when the temperature of the driving source is less than the first predetermined temperature. Therefore, the supply of the cooling fluid can be arbitrarily controlled by driving the electric motor according to the temperature of the driving source. As a result, for example, when a warm-up operation is performed in a low-temperature state of the driving source, as when an engine is warmed up, it is possible to control adequately the supplied amount of the cooling fluid by the driving control of the electric motor, perform an efficient warm-up operation, and minimize the pump driving energy supplied from the engine.

DESCRIPTION OF THE EMBODIMENTS

Figure 1:
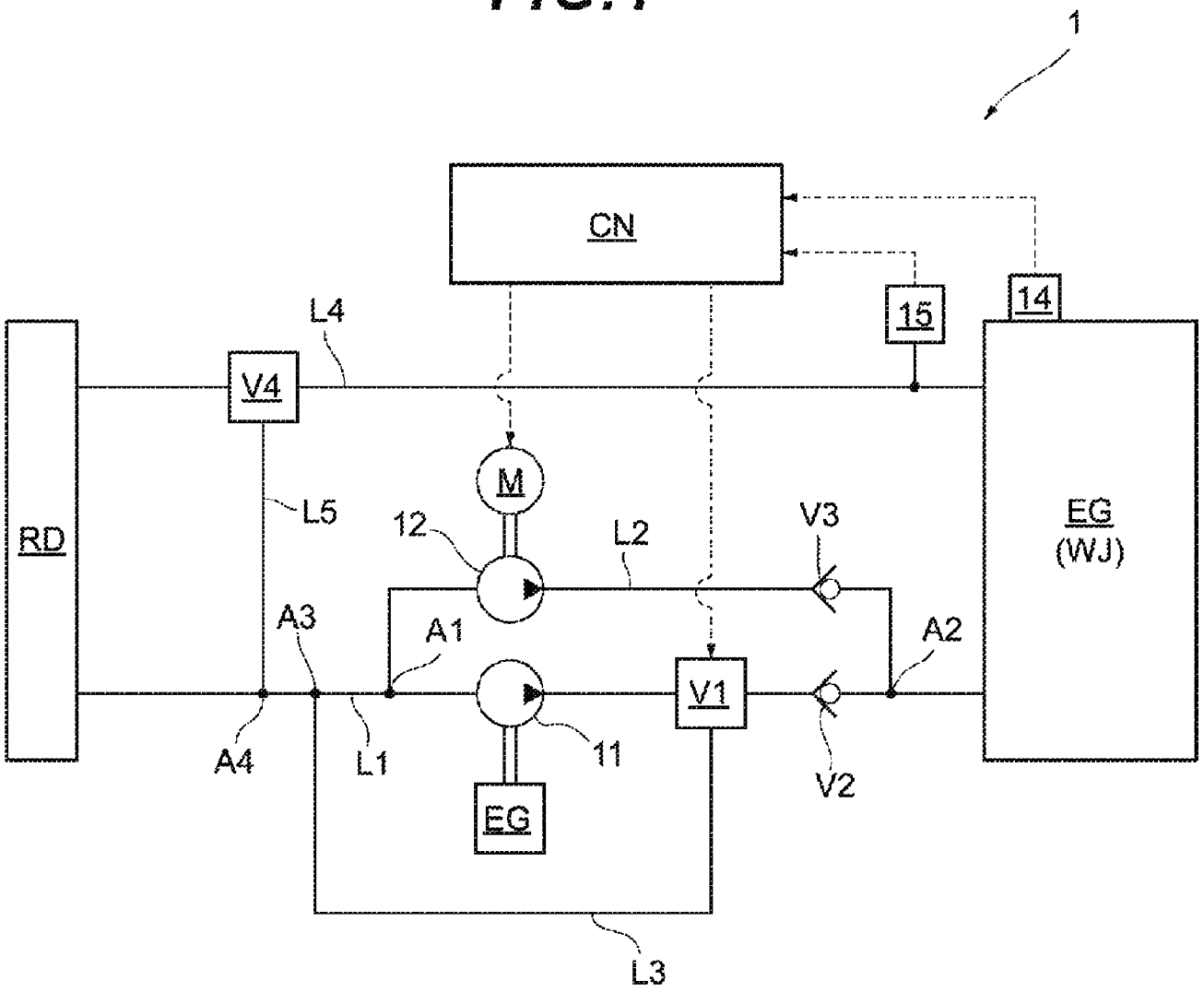
FIG. 1 is a block diagram illustrating the configuration of the engine cooling device according to the first embodiment.

The embodiments of the present invention will be described hereinbelow with reference to the appended drawings. Initially, an engine cooling device 1 that is provided at an engine EG for an automobile and cools the engine EG will be explained by way of example as a fluid supply device according to the first embodiment. In FIG. 1, the configuration of the engine cooling device 1 is illustrated by a block diagram. Initially, the entire configuration of the engine cooling device 1 will be explained hereinbelow with reference to FIG. 1. The engine cooling device 1 forcibly circulates cooling water in a water jacket WJ formed inside a cylinder block of the engine EG, performs appropriate cooling of the engine EG in combination with a radiator RD, and controls the supply of cooling water such as to prevent overheating under severe operation conditions.

The engine cooling device 1 is provided with a first supply flow path L1 linking together an outlet of the radiator RD and an inlet of the water jacket WJ of the engine EG, a second supply flow path L2 that is branched off from the first supply flow path L1 (branch point A1), extends parallel thereto, and then merges with the first supply flow path L1 (merging point A2), a circulation flow path L3 that branches off from a (below-described) first flow path switching valve V1 provided in the first supply flow path L1, returns to an upstream side, and connects to the first supply flow path L1 (merging point A3), and a return flow path L4 linking together an outlet of the water jacket WJ of the engine EG and an inlet of the radiator RD.

The engine cooling device 1 is further provided with a first supply pump 11 provided between the branch point A1 and the merging point A2 in the first supply flow path L1 and driven by the engine EG, the first flow path switching valve V1 provided on a discharge side of the first supply pump 11, a second supply pump 12 provided in the second supply flow path L2, an electric motor M that drives the second supply pump 12, a revolution speed detector 14 that detects a revolution speed of the engine EG, a temperature detector 15 that detects the temperature of cooling water inside the return flow path L4 (that is, the temperature of cooling water flowing inside the water jacket WJ of the engine EG), and a controller CN that controls the operation of the electric motor M and the first flow path switching valve V1.

The first supply pump 11 is constituted by a centrifugal pump and rotationally driven by a transmitted rotational driving power of a crankshaft of the engine EG. As a result, the cooling water in an amount proportional to the rotation of the engine EG is discharged by the first supply pump 11 from the radiator RD side to the first flow path switching valve V1 side. The first flow path switching valve V1 is configured to be capable of switching between a supply position in which the cooling water discharged from the first supply pump 11 is supplied to the water jacket WJ side and a return position in which the cooling water is returned to the upstream side (merging point A3) of the first supply pump 11 through the circulation flow path L3, without being supplied to the water jacket WJ side. In this case, the opening degree can be adjusted between the supply position and return position, and the ratio of the amount of cooling water supplied to the water jacket WJ side and the amount of cooling water supplied to the circulation flow path L3 can be controlled by opening degree control. For this purpose, for example, the first flow path switching valve V1 is configured from a duty control solenoid valve to perform duty ratio control, or configured from a proportional control valve to perform proportional control of the flow rate. A first check valve V2 is provided downstream of the first flow path switching valve V1 and upstream of the merging point A2 in the first supply flow path L1. The first check valve V2 allows the cooling water to flow from the first flow path switching valve V1 side to the water jacket WJ side and restricts the flow in the opposite direction.

The first supply pump 11 may be configured from a valve of another system. Further, where the first supply pump 11 is configured from a centrifugal pump, as indicated hereinabove, the circulation flow path L3 may be eliminated and the first flow path opening-closing valve V1 may be configured from a valve that performs opening-closing control of the first supply flow path L1. This is because in the case of a centrifugal pump, the pump driving power of the engine EG is small correspondingly to the idling of the pump impeller even when the discharge side of the pump is closed by the first flow path switching valve V1.

The second supply pump 12 is also constituted by centrifugal pump and rotationally driven by the electric motor M. The cooling water in an amount proportional to the rotation of the electric motor M is supplied from the second supply pump 12 to the to the water jacket WJ through the second supply flow path L2 and the first supply flow path L1. The first supply pump 11 may be also configured from a valve of another system. A second check valve V3 is provided downstream of the second supply pump 12 in the second supply flow path L2. The second check valve V3 allows the cooling water to flow from the second supply pump 12 side to the water jacket WJ side and restricts the flow in the opposite direction.

The controller CN receives the detection signals detected by the revolution speed detector 14 and the temperature detector 15 and performs the operation control of the electric motor M and the first flow path switching valve V1 on the basis of the detection signals (this control is explained hereinbelow in detail). The controller CN is provided with a memory that stores a cooling program of the engine EG or the like. The memory stores necessary control information such as a first reference revolution speed Ra which is higher than an engine revolution speed R1 during idling and serves as a reference for switching control of the first flow path switching valve V1, a second reference revolution speed Rb (>Ra), and a warm-up end temperature Ta (see the below-described FIG. 3).

A second flow path switching valve V4 that is actuated by a thermostat is provided in the return flow path L4. The second flow path switching valve V4 is configured to be capable of switching between a radiator-side supply position in which the cooling water returning from the water jacket WJ flows to the radiator RD side and a bypass-side supply position in which the cooling water flows to the first supply flow path L1 (merging point A4) through a bypass flow path L5. The second flow path switching valve V4 is positioned at the bypass supply position when the temperature (cooling water temperature) of the engine EG is lower than a predetermined temperature, which should be maintained, and the switching of the valve to the radiator-side supply position is started when the predetermined temperature is exceeded.

Figure 2:
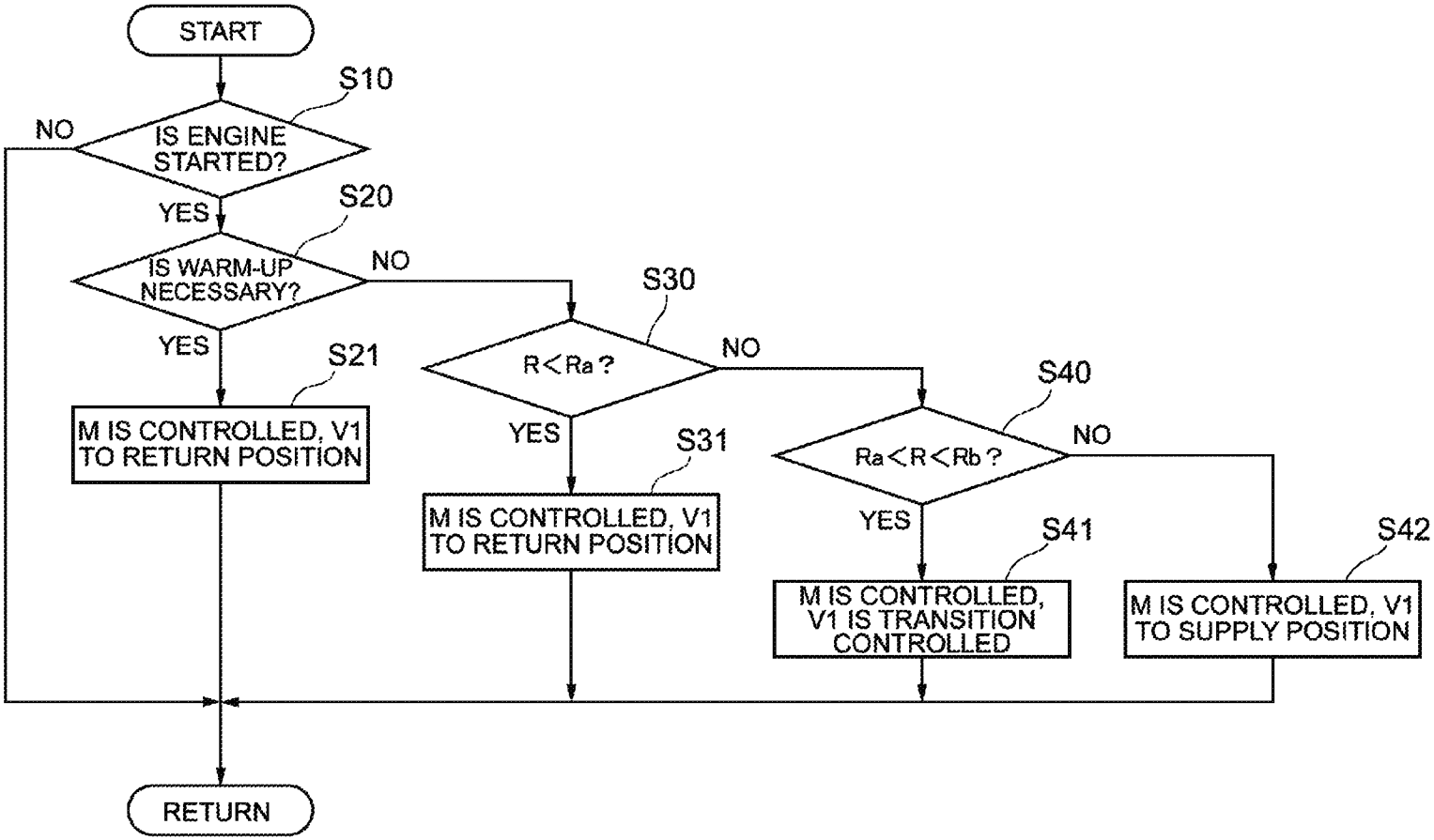
FIG. 2 is a flow chart of control for cooling the engine with the engine cooling device.

Described hereinabove is the configuration of the entire engine cooling device 1 according to Embodiment 1. Cooling control performed when the cooling water is forcibly circulated to the water jacket WJ by the engine cooling device 1 to cool the engine EG is explained hereinbelow along the flowchart depicted in FIG. 2. The control flow depicted in FIG. 2 is repeatedly performed at a predetermined control interval (for example, every 10 ms).

In the control, initially, in step S10, the controller CN determines whether the engine EG is driven or stopped on the basis of the revolution speed detection signal (signal indicating the revolution speed R of the engine EG) of the engine EG which is sent from the revolution speed detector 14. When it is determined that the engine EG has been driven, the processing advances to step S20, and when it is determined that the engine EG has been stopped, the processing flow is ended.

Where the processing advances from step S10 to step S20, it is determined whether or not a warm-up operation, in which the temperature of the engine EG is raised to a temperature suitable for driving, is needed on the basis of the cooling water temperature detection signal sent from the temperature detector 15. This determination is performed by comparing a warm-up completion temperature Ta which is stored in the memory with a cooling water temperature T detected by the temperature detector 15. Where the comparison result indicates that the cooling water temperature T is lower than the warm-up completion temperature Ta, the warm-up operation is needed. Therefore, the processing advances to step S21. Meanwhile, where the cooling water temperature T is higher than the warm-up completion temperature Ta, the warm-up operation is not needed. Therefore, the processing advances to step S30.

In step S21, the warm-up operation is performed by raising the temperature of the engine EG at a comparatively low speed, without applying a load. The warm-up operation serves to raise the temperature of the engine EG, which is in a low-temperature state, to a temperature suitable for driving, but it is preferred that the temperature of the engine EG be raised efficiently and over a short period of time by reducing the amount of cooling water supplied to the water jacket WJ. For this reason, in step S21, control is performed to restrict the amount of cooling water supplied to the water jacket WJ. In this case, since the first supply pump 11 is driven by the engine EG, the cooling water is discharged in an amount proportional to the revolution speed of the engine. As a result, the cooling water discharged from the first supply pump 11 is supplied to the water jacket WJ. Thus, the control restricting the amount of cooling water is impossible.

Accordingly, in step S21, the controller CN outputs an actuation signal to the first flow path switching valve V1 and performs control of switching the first flow path switching valve V1 to the return position. As a result of such switching control, the cooling water discharged from the first supply pump 11 is returned upstream of the first supply pump 11 through the circulation flow path L3, without being supplied to the water jacket WJ. As a consequence, the amount of cooling water supplied to the water jacket WJ of the engine EG is suppressed and the engine temperature can be rapidly raised by the warm-up operation. At the same time, the driving load of the first supply pump 11 is suppressed and the driving load of the engine EG can be suppressed. However, where the amount of cooling water supplied to the water jacket WJ is made zero, the engine EG is locally overheated, thereby causing problems such as seizure. Further, the control is needed that gradually increases the amount of cooling water as the engine temperature (engine cooling water temperature) is raised from the low-temperature state by the warm-up operation and the cooling water temperature T approaches the warm-up completion temperature Ta.

For this reason, in step S21, the controller CN controls the drive of the electric motor M on the basis of the detection signal (cooling water temperature T) from the temperature detector 15 and performs the control of supplying the cooling water from the second supply pump 12 to the water jacket WJ. With this control, when the engine EG is initially in a low-temperature state, the drive of the electric motor M is controlled such as to supply the cooling water in a minimum amount necessary to prevent the occurrence of problems such as local overheating and seizure of the engine EG. Then, the drive of the electric motor M is controlled such as to increase the amount of cooling water supplied to the water jacket WJ as the cooling water temperature T (temperature of the engine EG) is raised by the warm-up operation of the engine EG.

By performing the actuation control of the first flow path switching valve V1 and the electric motor M in the above-described manner, it is possible to perform the warm-up operation while supplying the cooling water in an amount corresponding to the temperature of the engine EG to the water jacket WJ. As a result, the driving load of the first supply pump created by the engine EG can be suppressed and the engine EG can be warmed up efficiently and over a short period of time. Then, in the same manner, after the engine EG has been started and before the warm-up operation is completed, steps S10, S20, and S21 are continuously executed by repeating the determination at every predetermined cycle, regardless of the revolution speed R of the engine EG. In this case, since the second flow path switching valve V4 is positioned at the bypass-side supply position and the cooling water is circulated inside the engine EG, without being supplied to the radiator RD, the warm-up operation can be performed with even higher efficiency.

Where the warm-up operation is thus completed and the cooling water temperature T of the engine EG becomes equal to or higher than the warm-up completion temperature Ta, the warm-up operation becomes unnecessary. Accordingly, the processing advances, as mentioned hereinabove, from step S20 to step S30. In step S30, initially, the controller CN reads the first reference revolution speed Ra stored in the memory and compares the first reference revolution speed Ra with the detection signal from the revolution speed detector 14 that is input in step S10 (that is, with the present revolution speed R of the engine EG). When it is determined on the basis of the comparison result that the revolution speed R is less than the first reference revolution speed Ra, that is, when the engine EG is driven at a comparatively low speed, the processing advances to step S31. When it is determined that the revolution speed R is larger than the first reference revolution speed Ra, the processing advances to step S40 and additional determination of the revolution speed R is performed.

The processing advances from step S30 to step S31 when the engine EG is operated in a low-speed revolution node, and the amount of heat generated in the engine EG at this time is comparatively small. In this case, where the cooling water discharged from the first supply pump 11 driven by the engine EG directly flows to the water jacket WJ, the amount of cooling water can be too large, in particular when the temperature of the engine EG is still low (but higher than the warm-up completion temperature Ta). Therefore, the controller CN performs the control of setting the first flow path switching valve V1 to the return position and returning the cooling water discharged from the first supply pump 11 upstream of the first supply pump 11 through the circulation flow path L3. At the same time, the controller CN controls the drive of the electric motor M on the basis of the detection signal from the temperature detector 15 (cooling water temperature T). As a result of such driving control, the cooling water in an amount corresponding to the cooling water temperature T is discharged from the second supply pump 12 and supplied to the water jacket WJ. By so controlling the actuation of the first flow path switching valve V1 and the electric motor M, it is possible to supply the cooling water in an amount corresponding to the temperature of the engine EG and perform appropriate cooling control of the engine while suppressing energy consumption in the engine EG (energy consumed on driving the first supply pump 11).

Even when the engine EG is operated in a low-speed revolution mode, when the engine temperature (cooling water temperature T) is high and the necessary cooling water amount is large, the control may be performed to switch the first flow path switching valve V1 to the supply position and supply the cooling water discharged from the first supply pump 11 to the water jacket WJ. In this case, where the supply from the first supply pump 11 falls short, the control may be performed to drive also the electric motor M and compensate the shortage by supply from the second supply pump 12.

Meanwhile, when the processing advances from step S30 to step S40, the controller CN reads also the second reference revolution speed Rb stored in the memory, and compares those first and second reference revolution speeds Ra, Rb with the present revolution speed R of the engine EG. When it is determined that the present revolution speed R of the engine EG is between the first reference revolution speed Ra and the second reference revolution speed Rb, the processing advances to step S41. Meanwhile, where it is determined that the revolution seed R is greater than the second reference revolution speed Rb, the processing advances to step S42.

The control in step 41 and step 42 is performed in the case in which the engine revolution speed increases when the above-described control in step 31 is performed, and transient control representing the transition to the control of step 42 is performed in step 41. The control performed in S42 is explained herein before explaining the control performed in step 41 which is the transient control. As follows from the explanation above, the control in step 31, step S41, and step S42 is performed in a state in which the warm-up operation of the engine EG has been completed, that is, in a state in which the cooling water temperature T of the engine EG has become equal to or higher than the warm-up completion temperature Ta.

The control in step S42 is performed in a state in which the revolution speed R of the engine EG is higher than the second reference revolution speed Rb, that is, when the engine EG operates at a high speed. In this case, since the amount of heat generated in the engine EG is also large according to the revolution speed R of the engine EG, the cooling water is required in an amount larger than that in step S31. Accordingly, the controller CN performs control of outputting an actuation signal to the first flow path switching valve V1 and switching the first flow path switching valve V1 to the supply position. As a result of such switching control, the cooling water discharged from the first supply pump 11 is supplied to the water jacket WJ, without being supplied to the circulation flow path L3. As a consequence, the cooling water in an amount proportional to the engine revolution speed is supplied from the first supply pump 11 driven by the engine EG to the water jacket WJ to cool the engine EG.

As indicated hereinabove, the control in step S42 is performed when the engine EG is operated at a high revolution speed, and where, for example, the engine load and external air temperature are high and the efficiency of cooling with the radiator RD decreases, the amount of cooling water discharged from the first supply pump 11 can be insufficient. Accordingly, the controller CN controls the driving of the electric motor M on the basis of the detection signal (revolution speed R) from the revolution speed detector 14 and the detection signal (cooling water temperature T) from the temperature detector 15. As a result of such driving control, the cooling water is discharged from the second supply pump 12 and supplied to the water jacket WJ so as to compensate the shortage of the cooling water discharged from the first supply pump 11. By controlling the actuation of the first flow path switching valve V1 and the electric motor M in the above-described manner, it is possible to supply the cooling water in an amount corresponding to the temperature and revolution speed of the engine EG and perform effective cooling that suppresses overheating of the engine EG, while reducing wasteful energy consumption.

With such a configuration in which the shortage of the cooling water from the first supply pump 11 is compensated by driving, as appropriate, the second supply pump 12, the first and second supply pumps 11, 12 can be reduced in size by comparison with the case in which the engine cooling device is configured from only the first supply pump 11 or only the second supply pump 12. Furthermore, as mentioned hereinabove, the driving of the first flow path switching valve V1 and the electric motor M is controlled according to the engine operation state, and optimum cooling water supply control with the highest efficiency is performed by using the first and second supply pumps 11, 12 selectively or in an appropriate combination. As a result, the driving energy of the first supply pump 11 provided by the engine EG can be reduced to a necessary minimum.

The control of step S41 is explained below. The control of step S41 is performed when it is determined, as mentioned hereinabove, that the revolution speed R of the engine EG is between the first reference revolution speed Ra and the second reference revolution speed Rb. As indicated hereinabove, when the revolution speed R of the engine EG is equal to or less than the first reference revolution speed Ra, the control of step S31 is performed, the first flow path switching valve V1 is switched to the return position, and the supply of cooling water is performed by the second supply pump 12 driven by the electric motor M. Meanwhile, where the revolution speed R of the engine EG is equal to or higher than the second reference revolution speed Rb, the control of step S42 is performed, the first flow path switching valve V1 is switched to the supply position, the supply of cooling water is performed by the first supply pump 11 driven by the engine EG, and the supply of cooling water by the second supply pump 12 driven by the electric motor M is added as necessary. In step S41, the control falling between those two types of control, that is, the transient control corresponding to the engine revolution, is performed.

More specifically, as the revolution speed R of the engine EG rises from the first reference revolution speed Ra to the second reference revolution speed Rb, the control is performed to change gradually the opening degree of the first flow path switching valve V1 from the return position to the supply position. As mentioned hereinabove, the first flow path switching valve V1 is configured from a duty ratio control valve or proportional control valve. In the return position, the first flow path switching valve V1 is fully open on the circulation flow path L3 side and fully closed on the water jacket WJ side. From this state, the control is performed to close gradually the opening on the circulation flow path L3 side and open gradually the opening on the water jacket WJ side. As a result, as the revolution speed R of the engine EG rises from the first reference revolution speed Ra to the second reference revolution speed Rb, the control is performed to increase the amount of cooling water supplied from the first supply pump 11 to the water jacket WJ side. In this case where the amount of cooling water supplied from the first supply pump 11 to the water jacket WJ side is insufficient for cooling, the control is performed to drive the second supply pump 12 with the electric motor M and compensate the amount of cooling water.

Figure 3:
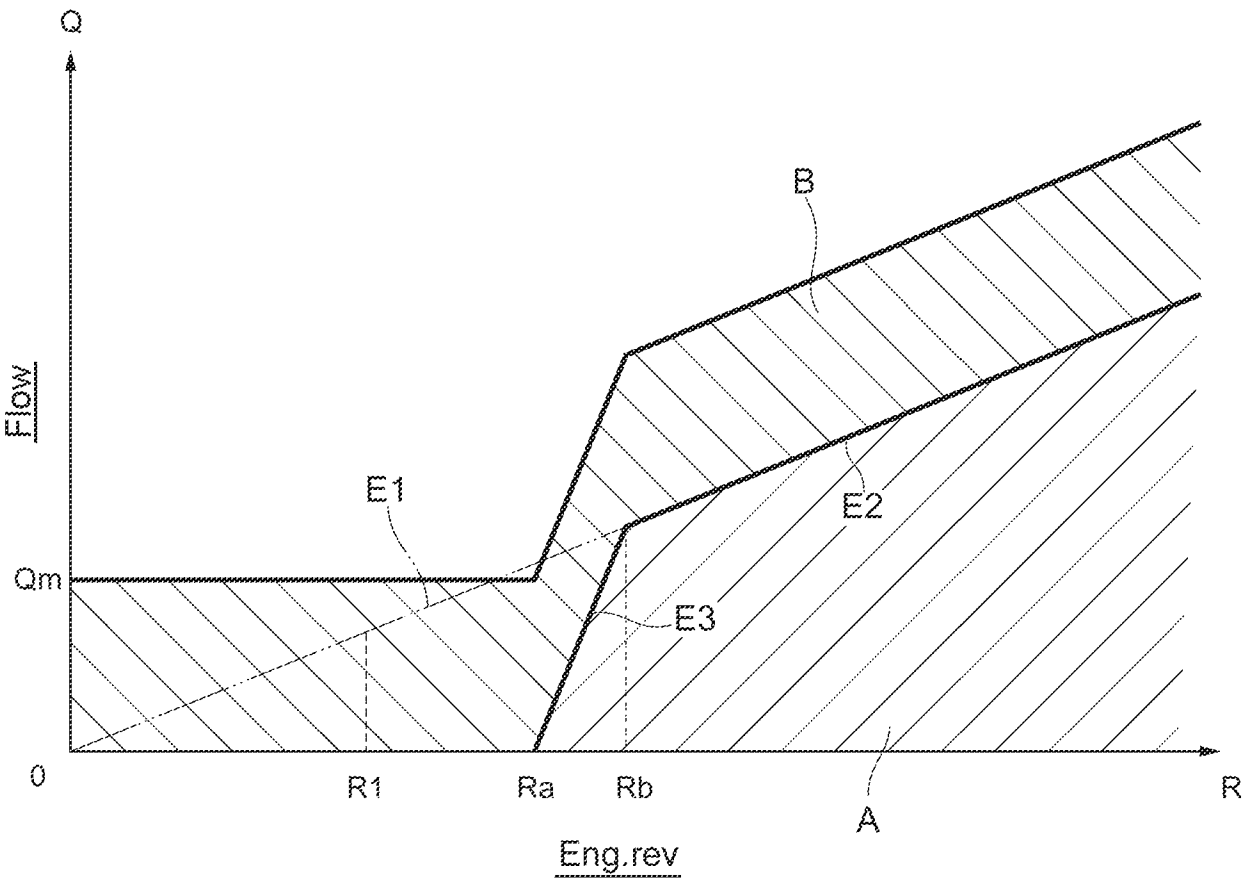
FIG. 3 is a graph illustrating the relationship between the engine revolution speed and the amount of cooling water discharged from the first and second supply pumps.
Figure 4:
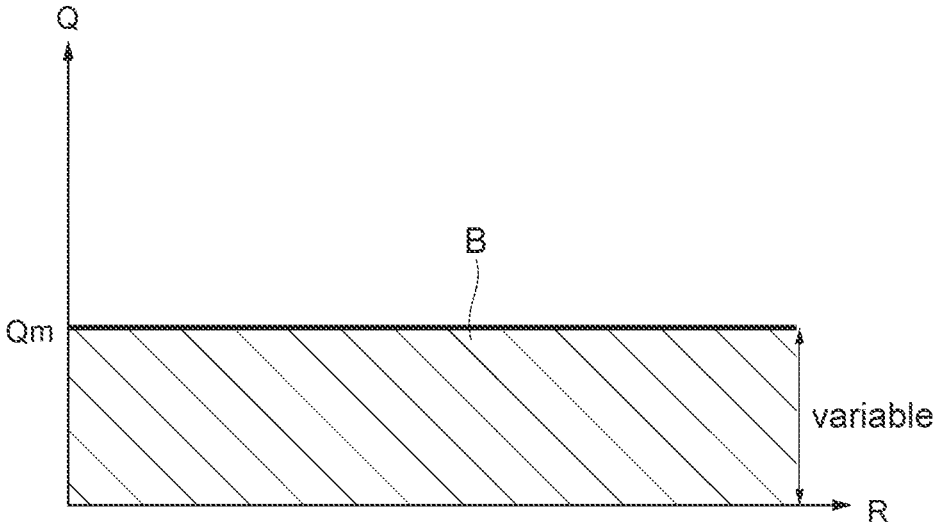
FIG. 4 is a graph illustrating the relationship between the engine revolution speed and the amount of cooling water discharged from the second supply pump.

Described hereinabove is the cooling control of the engine EG with the engine cooling device 1. The relationship between the amount of cooling water supplied to the engine EG with such control, the engine revolution, and the electric motor revolution is explained hereinbelow in a simple manner with reference to FIGS. 3 to 5. FIG. 4 illustrates the characteristic of cooling water amount supplied from the second supply pump 12 which is driven by the electric motor M to the water jacket WJ of the engine EG. The revolution of the electric motor M can be freely controlled regardless of the engine revolution, and the setting of the discharge amount of the second supply pump 12 can be controlled to an arbitrary discharge amount from the zero discharge amount to the maximum discharge amount Qm corresponding to the maximum drive revolution of the electric motor. Therefore, for example, the driving control of the electric motor M is performed such as to supply the cooling water at an optimum flow rate corresponding to the variation in the cooling water temperature T at the time of warm-up operation from the second supply pump 12 to the water jacket WJ, for example, as in the control in step S21. A similar driving control of the electric motor M is also performed in step S31. Further, in steps S41 and S42, the necessary driving control of the electric motor M is also performed, regardless of the engine revolution speed, when the supply from the engine-driven first supply pump 11 needs to be compensated.

Figure 5:
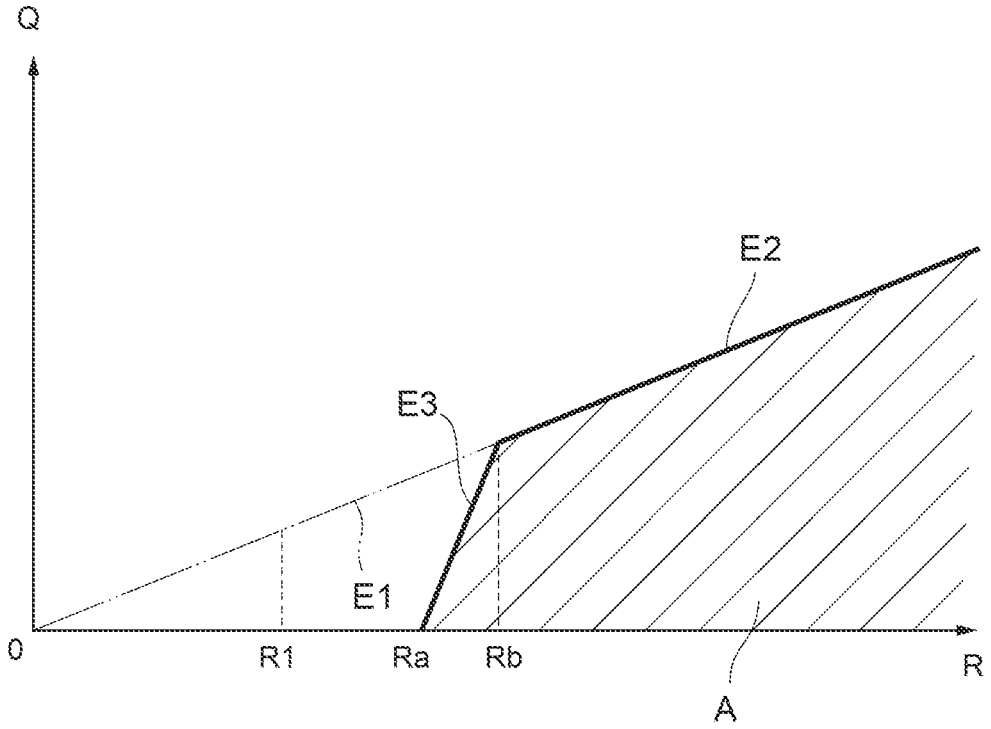
FIG. 5 is a graph illustrating the relationship between the engine revolution speed and the amount of cooling water discharged from the first supply pump.

FIG. 5 illustrates the characteristic of cooling water amount supplied from the first supply pump 11, which is driven by the engine EG, to the water jacket WJ of the engine EG. As mentioned hereinabove, with the control of step S31 which is performed when the revolution speed R of the engine EG is less than the first reference revolution speed Ra, the first flow path switching valve V1 is set to the return position and the cooling water discharged from the first supply pump 11 is returned to the portion upstream of the first supply pump 11 through the circulation flow path L3.

Therefore, in a region in which the engine revolution speed is less than the first reference revolution speed Ra, the amount of oil supplied to the water jacket WJ is zero.

Further, within an interval from the revolution speed R of the engine EG to the first reference revolution speed Ra, as the revolution speed R of the engine EG increases from the first reference revolution speed Ra to the second reference revolution speed Rb, the control is performed to change gradually the opening degree of the first flow path switching valve V1 from the return position to the supply position. As a result, the amount of cooling water supplied from the first supply pump 11 to the water jacket WJ increases at a comparatively high rate according to the increase in the engine revolution speed, as indicated by a line E3 in FIG. 5. When the revolution speed R of the engine EG is equal to or higher than the second reference revolution speed Rb, the first flow path switching valve V1 is switched to the supply position, and the entire cooling water discharged from the first supply pump 11 is supplied to the water jacket WJ side. Therefore, the amount of cooling water supplied from the first supply pump 11 to the water jacket WJ side is proportional to the engine revolution speed, as indicated by a line E2 in FIG. 5.

With the control performed in steps S41 and S42, the amount of cooling water supplied to the water jacket WJ represents the combination of flow rates supplied from the first and second supply pumps 11, 12. This result is illustrated by FIG. 3 in which the amount of supplied cooling water depicted in FIG. 4 and the amount of supplied cooling water depicted in FIG. 5 are added up.

Figure 6:
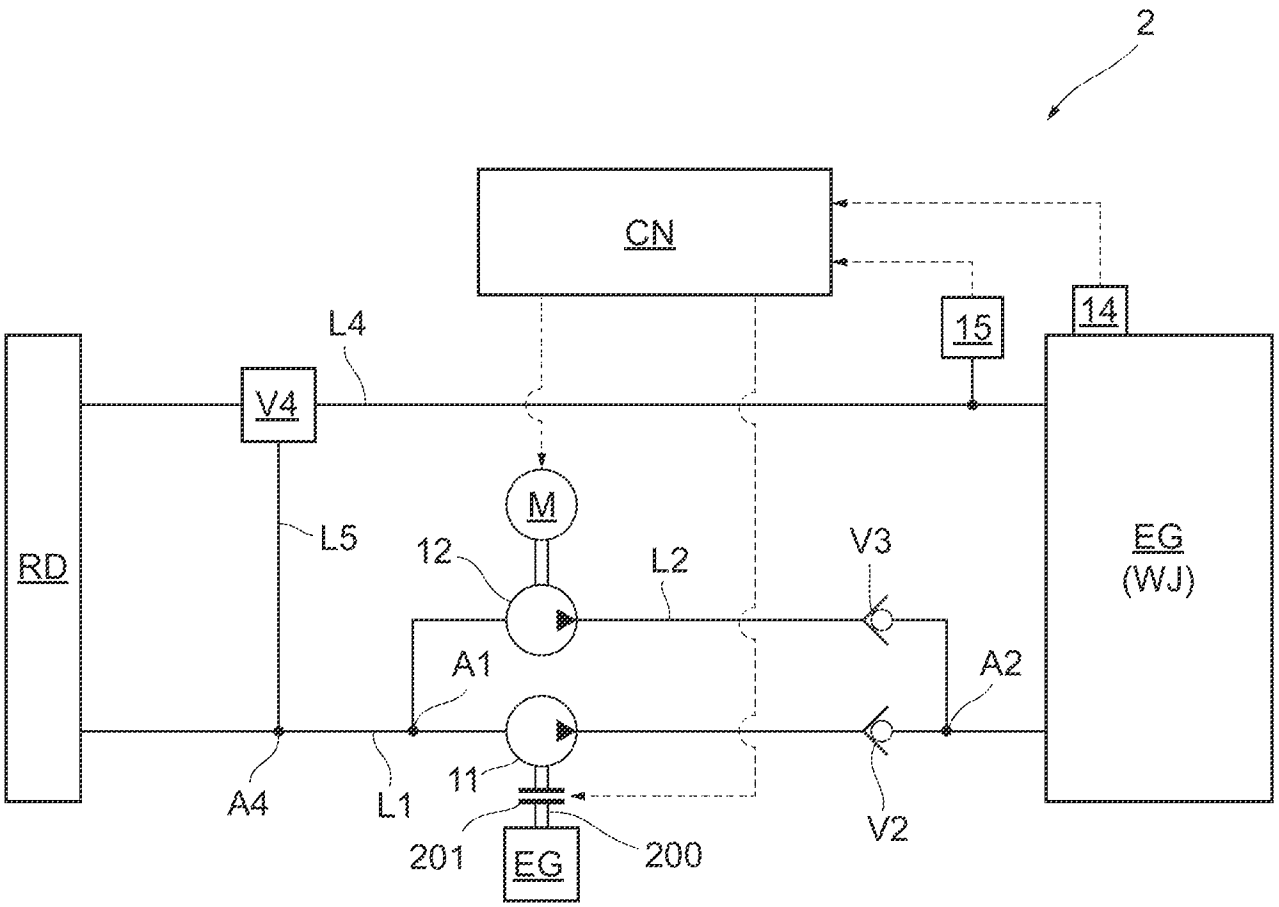
FIG. 6 is a block diagram illustrating the configuration of the engine cooling device according to the second embodiment.

An engine cooling device 2 according to the second embodiment will be explained hereinbelow with reference to FIG. 6. The explanation below is focused on features different from those of the above-described engine cooling device 1 according to the first embodiment, and parts like those of the engine cooling device 1 are assigned with like reference numerals and the explanation thereof is herein omitted.

The engine cooling device 2 is configured by providing a clutch mechanism 201 in a driving power transmission mechanism 200 that transmits the rotational driving power of the engine EG to the first supply pump, instead of the first flow path switching valve V1 in the engine cooling device 1. The clutch mechanism 201 is configured to be switchable between a connection state in which the rotational driving power of the engine EG is transmitted to the first supply pump 11 and a cut-off state in which the transmission of the rotational driving power to the first supply pump 11 is cut off. For example, a fluid coupling (fluid clutch) or a centrifugal clutch can be used as the clutch mechanism 201.

Where the clutch mechanism 201 is switched to the connection state, the rotational driving power of the engine EG is transmitted to the first supply pump 11 through the driving power transmission mechanism 200 and the clutch mechanism 201. As a result, the first supply pump 11 is driven at a rate proportional to the revolution speed of the engine EG, and the cooling water is discharged in an amount corresponding to the revolution speed of the engine EG and supplied to the water jacket WJ. Meanwhile, where the clutch mechanism 201 is switched to the cut-off state, the transmission of the rotational driving power to the first supply pump 11 is cut off and the first supply pump 11 is maintained in a stopping state. As a result, the cooling water is not discharged from the first supply pump 11, and no cooling water is supplied from the first supply pump 11 to the water jacket WJ.

The disengagement actuation of the clutch mechanism 201 is controlled on the basis of the actuation signal that is output from the controller CN. More specifically, in steps S21 and S31 illustrated by FIG. 2, the control is performed to the cut-off state. In step S41, the control is aimed at gradual disengagement, and in step S42, the control is performed to obtain the connection state. Thus, with the configuration using the clutch mechanism 201 instead of the first flow path switching valve V1, the first supply pump 11 is not rotationally driven when the cooling water is not supplied from the first supply pump 11 to the water jacket WJ. Therefore, the wasteful consumption of energy can be further suppressed.

In the above-described embodiments, an example is described in which a non-positive displacement type pump (centrifugal pump) is used as the first and second supply pumps 11, 12, but a displacement pump (for example, a gear pump) can be also used.

In the above-described embodiments, cooling control which is performed when the engine EG is operated is explained, and in addition to such cooling control, the engine EG can be also cooled by performing the control of driving the electric motor M even after the engine EG has been stopped.

In the above-described embodiments, an example is explained in which the present invention is used in the engine cooling device 1 provided at the automobile engine EG, but the present invention can be also used in a fluid supply device for cooling a power motor or drive mechanism by forcibly circulating a cooling fluid. Further, in the above-described embodiments, the feature of causing forced circulation of cooling water as a coolant is explained by way of example, but cooling oil or cooling air can be also used instead of the cooling water.

In the above-described embodiments, the configuration in which the second flow path switching valve V4 is provided in the return flow path L4 is described by way of example. However, for example, when the warm-up operation can be performed with good efficiency by the control of step S21, an engine cooling device can be configured in which the second flow path switching valve V4 and the bypass flow path L5 are omitted.

EXPLANATION OF NUMERALS AND CHARACTERS

1, 2 engine cooling device (fluid supply device)
11 first supply pump
12 second supply pump
EG engine
RD radiator
CN controller
WJ water jacket

The invention claimed is:

1. A fluid supply device that supplies a cooling fluid to a rotational driving source and cools the driving source, the fluid supply device comprising:

a first supply pump that is driven by the driving source and supplies the cooling fluid to the driving source;

a second supply pump that is driven by an electric motor and supplies the cooling fluid to the driving source;

supply switching means for switching between a supply state in which the cooling fluid is supplied by the first supply pump to the driving source and a restricted state in which the supply of the cooling fluid by the first supply pump to the driving source is restricted;

temperature detection means for detecting a temperature of the driving source;

revolution speed detection means for detecting a revolution speed of the driving source; and actuation control means for controlling actuation of the electric motor and the supply switching means on the basis of detection results from the temperature detection means and the revolution speed detection means, wherein when the temperature of the driving source detected by the temperature detection means is less than a first predetermined temperature, the actuation control means performs control to restrict the supply of the cooling fluid from the first supply pump to the driving source by switching the supply switching means to the restricted state, and to supply the cooling fluid from the second supply pump to the driving source by performing control to drive the electric motor.

2. The fluid supply device according to claim 1, wherein the actuation control means is configured such that, when the temperature of the driving source detected by the temperature detection means is equal to or higher than the first predetermined temperature, the actuation control means:

restricts the supply of the cooling fluid from the first supply pump to the driving source by switching the supply switching means to the restricted state, and causes the cooling fluid to be supplied from the second supply pump to the driving source by performing control to drive the electric motor, when the revolution speed of the driving source detected by the revolution speed detection means is less than a first predetermined revolution speed;

performs control to increase slowly the supply of the cooling fluid from the first supply pump to the driving source by performing control to switch the supply switching means slowly from the restricted state to the supply state as the revolution speed of the driving source increases from the first predetermined revolution speed to a second predetermined revolution speed, when the revolution speed of the driving source detected by the revolution speed detection means is equal to or greater than the first predetermined revolution speed and less than the second predetermined revolution speed; and causes the cooling fluid to be supplied from the first supply pump to the driving source by switching the supply switching means to the supply state, when the revolution speed of the driving source detected by the revolution speed detection means is equal to or greater than the second predetermined revolution speed.

3. The fluid supply device according to claim 2, wherein when the revolution speed of the driving source detected by the revolution speed detection means is equal to or greater than the first predetermined revolution speed and less than the second predetermined revolution speed and when the revolution speed of the driving source is equal to or greater than the second predetermined revolution speed, control to drive the electric motor is also performed to cause the cooling fluid to be supplied also from the second supply pump to the driving source.

4. The fluid supply device according to claim 1, wherein the actuation control means is configured to control a revolution speed of the electric motor according to at least either one of the revolution speed detected by the revolution speed detection means and the temperature detected by the temperature detection means, when the electric motor is driven.

5. The fluid supply device according to claim 1, wherein the supply switching means is configured from a switching valve provided in a flow path through which the cooling fluid discharged from the first supply pump is supplied to the driving source, and switching between the supply state in which the cooling fluid is supplied from the first supply pump to the driving source and the restricted state in which the supply of the cooling fluid from the first supply pump to the driving source is restricted is performed by switching actuation of the switching valve.

6. The fluid supply device according to claim 1, wherein the supply switching means is configured from a power transmission control device provided in a power transmission system which transmits rotational driving power from the driving source to the first supply pump, and switching between the supply state in which the first supply pump is driven by the driving source to supply the cooling fluid from the first supply pump to the driving source and the restricted state in which the drive of the first supply pump by the driving source is cut off to restrict the supply of the cooling fluid from the first supply pump to the driving source is performed by actuation control of the power transmission control device.

7. The fluid supply device according to claim 1, wherein the first supply pump and the second supply pump are provided in parallel, and wherein the supply switching means is provided downstream of the first supply pump and is not provided in a flow path of the second supply pump.

8. A fluid supply device that supplies a cooling fluid to a rotational driving source and cools the driving source, the fluid supply device comprising:

a first supply pump that is driven by the driving source and supplies the cooling fluid to the driving source;

a second supply pump that is driven by an electric motor and supplies the cooling fluid to the driving source;

a flow path switching valve which switches between a supply state in which the cooling fluid is supplied by the first supply pump to the driving source and a restricted state in which the supply of the cooling fluid by the first supply pump to the driving source is restricted;

temperature detector which detects a temperature of the driving source;

revolution speed detector which detects a revolution speed of the driving source; and controller which actuates the electric motor and the flow path switching valve on the basis of detection results from the temperature detector and the revolution speed detector, wherein when the temperature of the driving source detected by the temperature detector is less than a first predetermined temperature, the controller performs control to restrict the supply of the cooling fluid from the first supply pump to the driving source by switching the flow path switching valve to the restricted state, and to supply the cooling fluid from the second supply pump to the driving source by performing control to drive the electric motor.

9. The fluid supply device according to claim 8, wherein the controller is configured such that, when the temperature of the driving source detected by the temperature detector is equal to or higher than the first predetermined temperature, the controller:

restricts the supply of the cooling fluid from the first supply pump to the driving source by switching the flow path switching valve to the restricted state, and causes the cooling fluid to be supplied from the second supply pump to the driving source by performing control to drive the electric motor, when the revolution speed of the driving source detected by the revolution speed detector is less than a first predetermined revolution speed;

performs control to increase slowly the supply of the cooling fluid from the first supply pump to the driving source by performing control to switch the flow path switching valve slowly from the restricted state to the supply state as the revolution speed of the driving source increases from the first predetermined revolution speed to a second predetermined revolution speed, when the revolution speed of the driving source detected by the revolution speed detector is equal to or greater than the first predetermined revolution speed and less than the second predetermined revolution speed; and causes the cooling fluid to be supplied from the first supply pump to the driving source by switching the flow path switching valve to the supply state, when the revolution speed of the driving source detected by the revolution speed detector is equal to or greater than the second predetermined revolution speed.

10. The fluid supply device according to claim 9, wherein when the revolution speed of the driving source detected by the revolution speed detector is equal to or greater than the first predetermined revolution speed and less than the second predetermined revolution speed and when the revolution speed of the driving source is equal to or greater than the second predetermined revolution speed, control to drive the electric motor is also performed to cause the cooling fluid to be supplied also from the second supply pump to the driving source.

11. The fluid supply device according to claim 8, wherein the controller is configured to control a revolution speed of the electric motor according to at least either one of the revolution speed detected by the revolution speed detector and the temperature detected by the temperature detector, when the electric motor is driven.

12. The fluid supply device according to claim 8, wherein the flow path switching valve is configured from a switching valve provided in a flow path through which the cooling fluid discharged from the first supply pump is supplied to the driving source, and switching between the supply state in which the cooling fluid is supplied from the first supply pump to the driving source and the restricted state in which the supply of the cooling fluid from the first supply pump to the driving source is restricted is performed by switching actuation of the flow path switching valve.

13. The fluid supply device according to claim 8, wherein the flow path switching valve is configured from a power transmission control device provided in a power transmission system which transmits rotational driving power from the driving source to the first supply pump, and switching between the supply state in which the first supply pump is driven by the driving source to supply the cooling fluid from the first supply pump to the driving source and the restricted state in which the drive of the first supply pump by the driving source is cut off to restrict the supply of the cooling fluid from the first supply pump to the driving source is performed by actuation control of the power transmission control device.

14. The fluid supply device according to claim 8, wherein the first supply pump and the second supply pump are provided in parallel, and wherein the flow path switching valve is provided downstream of the first supply pump and is not provided in a flow path of the second supply pump.

* * * * *